US008245394B2

(12) United States Patent
Seitter et al.

(10) Patent No.: US 8,245,394 B2
(45) Date of Patent: Aug. 21, 2012

(54) METHOD FOR PRODUCING A RIGID MAGNETIC CIRCUIT COMPONENT

(75) Inventors: Max Seitter, Muehlacker (DE); Stefan Oetinger, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 375 days.

(21) Appl. No.: 12/312,694

(22) PCT Filed: Sep. 25, 2007

(86) PCT No.: PCT/EP2007/060132

§ 371 (c)(1),
(2), (4) Date: Feb. 2, 2010

(87) PCT Pub. No.: WO2008/061829

PCT Pub. Date: May 29, 2008

(65) Prior Publication Data

US 2010/0126007 A1 May 27, 2010

(30) Foreign Application Priority Data

Nov. 22, 2006 (DE) ..... 10 2006 055 010

(51) Int. Cl.
*H01K 3/22* (2006.01)

(52) U.S. Cl. ..... 29/851; 29/829; 29/854; 335/302; 335/303; 335/304; 335/306; 367/166; 381/405; 381/423

(58) Field of Classification Search ..... 29/829, 29/851, 854; 335/302–306; 381/405, 423; 367/166

See application file for complete search history.

(56) References Cited

U.S. PATENT DOCUMENTS

| | | | | |
|---|---|---|---|---|
| 5,944,262 | A | 8/1999 | Akutagawa et al. | |
| 7,611,590 | B2 * | 11/2009 | Liang | 148/324 |
| 2006/0283526 | A1 * | 12/2006 | Liang | 148/324 |

FOREIGN PATENT DOCUMENTS

| | | |
|---|---|---|
| AU | 57365 73 | 1/1975 |
| DE | 35 02 287 | 7/1986 |
| DE | 42 37 405 | 6/1993 |
| DE | 196 50 710 | 6/1997 |
| EP | 0 204 293 | 12/1986 |
| EP | 0 629 711 | 12/1994 |

* cited by examiner

*Primary Examiner* — Paul D Kim
(74) *Attorney, Agent, or Firm* — Kenyon & Kenyon LLP

(57) ABSTRACT

A method for producing a rigid magnetic circuit component for an electromagnetically operable valve includes: a) providing a base element made of a magnetic or a magnetizable material, b) complete first heat treatment of the base element, c) a local second heat treatment of the base element so as to form a subregion having a microstructure of martensite and residual austenite in the otherwise martensitic base element, and d) installing the finished processed base element as the magnetic circuit component in a magnetic circuit.

8 Claims, 5 Drawing Sheets

METHOD FOR PRODUCING A RIGID MAGNETIC CIRCUIT COMPONENT

BACKGROUND OF THE INVENTION

1. Field of the Invention

The present invention relates to a method for producing a rigid magnetic circuit component for an electromagnetically operable value.

2. Description of Related Art

FIG. 1 shows a known fuel injector from the related art, which has a classical three-part construction of an inner metallic flow guidance part and a housing component at the same time. This inner valve pipe is formed by an intake nipple forming an inner pole, a nonmetallic intermediate part and a valve-seat support accommodating a valve seat, and is described in more detail in the associated description of FIG. 1.

A method is known from published German patent document DE 35 02 287 for producing a hollow cylindrical metallic housing having two magnetizable housing parts and a magnetic housing zone lying between them and separating the housing parts magnetically. This metallic housing is preworked, in this context, from a magnetizable blank in one piece, right down to an oversize in the outer diameter, an annular groove being cut into the inner wall of the housing to a width of the desired middle housing zone. With the housing rotating, a nonmagnetizable filler material is filled into the annular groove, while the annular groove region is heated, and the rotation of the housing is kept going until the filler material solidifies. The housing is subsequently over-rotated on the outside up to the end measure of the outer diameter, so that there is no longer any connection between the magnetizable housing parts. A valve housing produced in this manner may be used, for instance, in magnetic valves for antilock systems (ABS) of motor vehicles.

Methods are also known from published German patent document DE 42 37 405 for producing a rigid core for injection valves for internal combustion engines (see FIG. 5 of the cited German patent document). The methods are distinguished in that they provide a one-piece, sleeve-shaped, magnetic martensitic workpiece, directly or via prior conversion processes, which experiences a local heat treatment in a middle section of the magnetic, martensitic workpiece for converting this middle section into a nonmagnetic, austenitic middle section. Alternatively, during the local heat treatment, using a laser, elements forming molten austenite or molten ferrite are added to the location of the heat treatment to form a nonmagnetic, austenitic middle section of the rigid core.

BRIEF SUMMARY OF THE INVENTION

The method, according to the present invention, for producing a rigid magnetic circuit component having the characterizing features of the main claim, has the advantage that, in a particularly simple and cost-effective method, housings are reliably producible that have magnetic separation and magnetic circuit components having locally adjusted magnetic properties especially in edge layers, using mass-production techniques.

In particular, because of the simplicity of the individual components, only a reduced expenditure on special tools is required, compared to known production methods.

It is also of advantage that great flexibility is made possible in the development of the geometry of the magnetic circuit component itself, such as length, outside diameter and gradations.

It is of special advantage that one is able to do without coating methods, such as carbonitriding, which are usually required to generate edge layers that are modified in their magnetic properties.

DETAILED DESCRIPTION

Figure 1:
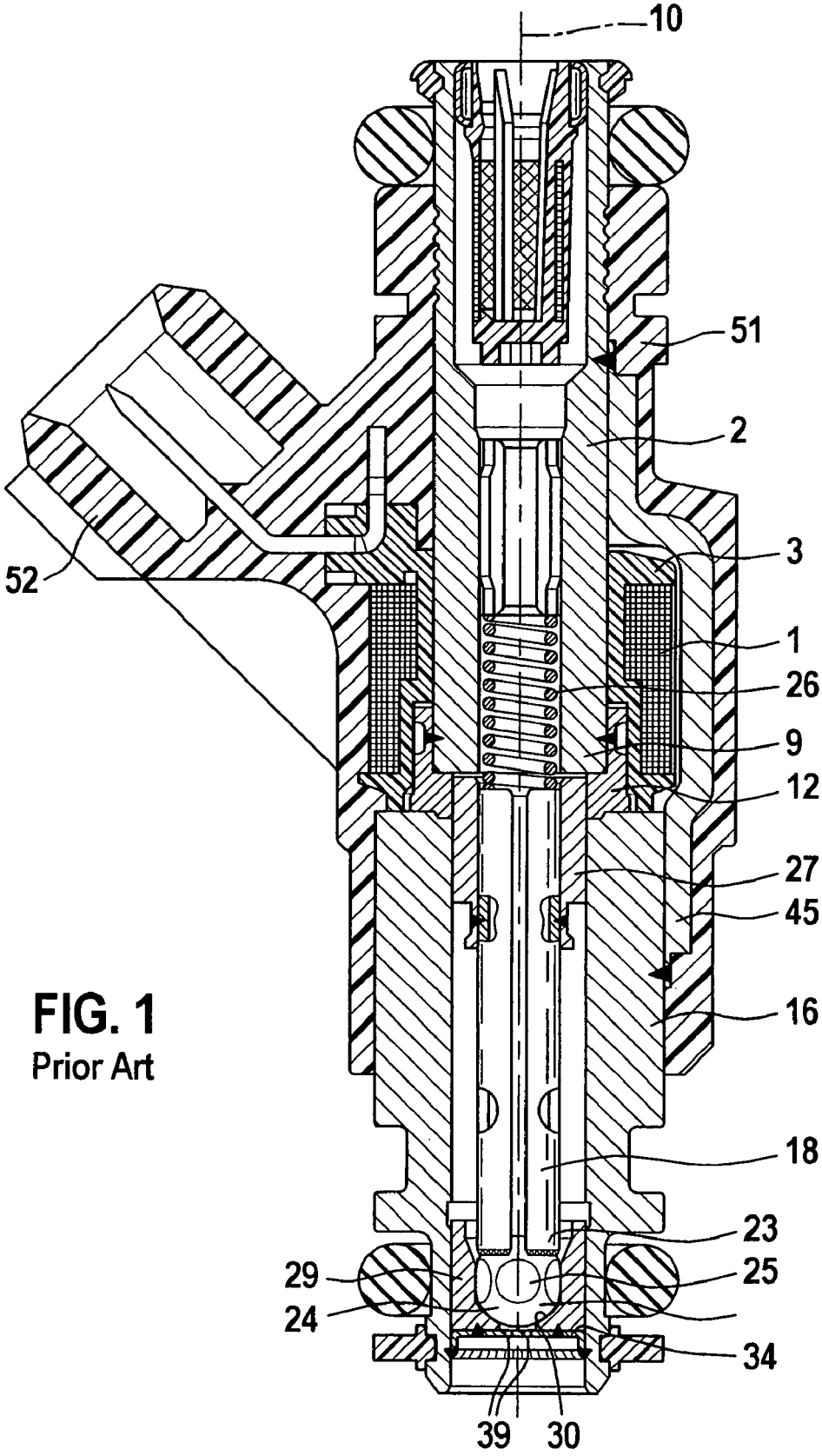
FIG. 1 Prior Art
FIG. 1 shows a fuel injector according to the related art, having a three-part inner metallic valve pipe as housing.
Figure 2:
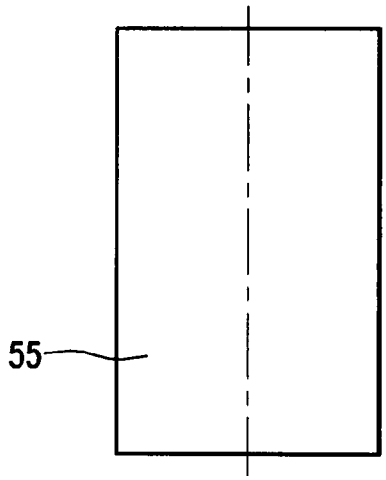
FIGS. 2 to 7 show schematic method steps of a method according to the present invention, for producing a rigid magnetic circuit component in the form of a pipe-shaped housing.

Before describing the method steps according to the present invention, for producing a rigid magnetic circuit component, with the aid of FIGS. 2 to 15, we shall explain in greater detail a fuel injector of the related art, with the aid of FIG. 1, as a possible product for the insertion of a magnetic circuit component produced according to the present invention.

The valve that is operable electromagnetically, shown in exemplary fashion in FIG. 1 in the form of an injector for fuel injection systems of mixture-compressing, externally ignited internal combustion engines, has a core 2, surrounded by a magnetic coil 1, used as fuel intake neck and inner pole, which has, for example, a constant outer diameter over its entire length. A coil shell 3 graded in the radial direction accommodates a winding of magnetic coil 1 and, in conjunction with core 2, enables the fuel injector to have a compact design in the region of magnetic coil 1.

A tubular, metal, nonmagnetic intermediate part 12 is connected to a lower core end 9 of core 2 by welding, concentrically to a longitudinal valve axis 10, and partially surrounds core end 9 in an axial manner. A tubular valve-seat support 16, which is rigidly connected to intermediate part 12, extends downstream from coil shell 3 and intermediate part 12. An axially movable valve needle 18 is situated in valve seat support 16. At downstream end 23 of valve needle 18 a spherical valve closure member 24 is provided, at whose circumference, for example, five flattened regions 25 are provided for the fuel to flow past.

The fuel injector is actuated electromagnetically, in the known manner. For the axial displacement of valve needle 18, and thus for the opening counter to the spring force of a restoring spring 26, or for the closing of the fuel injector, the electromagnetic circuit having magnetic coil 1, core 2 and an armature 27 is utilized. Pipe-shaped armature 27 is rigidly connected to the end of valve needle 18 facing away from valve-closure member 24, by a welded seam, and is aligned with core 2. A cylindrical valve-seat member 29 having a fixed valve seat 30 is mounted in the downstream end of valve-seat support 16 facing away from core 2, using welding, so as to form a seal.

Spherical valve-closure member 24 of valve needle 18 interacts with the valve seat 30 of valve-seat member 29, which is frustoconically tapered in the direction of flow. At its lower end face, valve seat member 29 is connected to a pot-shaped spray orifice disk 34, for example, rigidly and sealingly by a welded seam that is developed, for example, using a laser. In spray orifice disk 34, at least one, but, for example, four, spray-discharge orifices 39 are provided that are formed by eroding or stamping, for example.

In order to conduct the magnetic flux for the optimal activation of armature 27, when magnetic coil 1 is supplied with current, and with that to the secure and accurate opening and closing of the valve, magnetic coil 1 is surrounded by at least one conductive element 45, developed, for instance, as a bracket and used as a ferromagnetic element, which surrounds magnetic coil 1 at least partially in the circumferential direction, and which lies with its one end against core 2 and with its other end against valve seat support 16, and is able to be connected to the latter, for instance, by welding, soldering or adhesion. Core 2, nonmagnetic intermediate part 12 and valve seat support 16 form an inner metallic valve pipe as skeleton and, with that also the housing of the fuel injector, and they are firmly connected to one another and altogether extend over the entire length of the fuel injector. All additional functional groups of the valve are ordered within or round about the valve pipe. This arrangement of the valve pipe involves the classical three-part design of a housing for an electromagnetically operable aggregate, such as a valve, having two ferromagnetic or magnetizable housing regions which, for the effective conduction of the magnetic circuit lines of force in the region of armature 27, are magnetically separated from each other or at least connected to each other via a magnetic throttling point, using a nonmagnetic intermediate part 12.

The fuel injector is largely surrounded by a plastic extrusion coat 51, which extends in the axial direction from core 2, over magnetic coil 1 and the at least one conductive element 45, to valve-seat support 16, the at least one conductive element 45 being completely covered in the axial and circumferential directions. Part of this plastic extrusion coating 51 is a likewise extruded electrical connection plug 52, for instance.

Using the method steps of the method according to the present invention that are schematically indicated in FIGS. 2 to 7, for producing a rigid magnetic circuit component, it is advantageously possible to produce, especially simply and cost-effectively, thin-walled housings 66 for various utilization purposes, among other things, preferably electromagnetically operable valves which are able to replace a three-part valve pipe described above.

In a first method step (FIG. 2) a base element 55, that is cylindrical, for example, is provided from which housing 66 is to be manufactured, and which is made of a magnetic or magnetizable material and is ferromagnetic or ferritic, for example, or has a martensitic microstructure. Base element 55 may be solidly developed, for the moment, and may be made from long rod material, for example, for an especially effective production of a plurality of housings 66. The material of base element 55 is steel in each case, which forms residual austenite and martensite based on its alloy composition. The alloying elements in the material are the elements C, N, Ni and Mn, which stabilize austenite.

Figure 3:
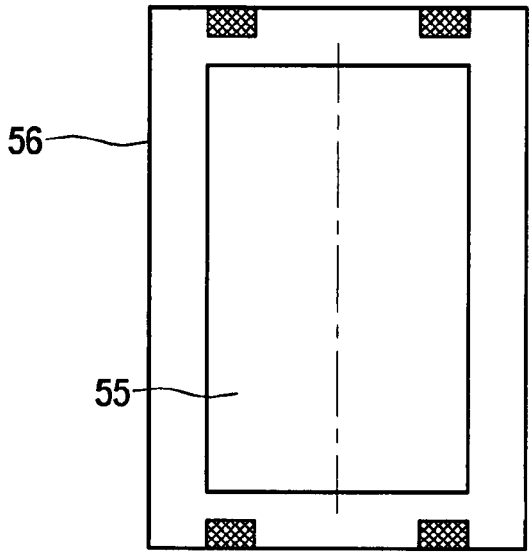
Figure 4:
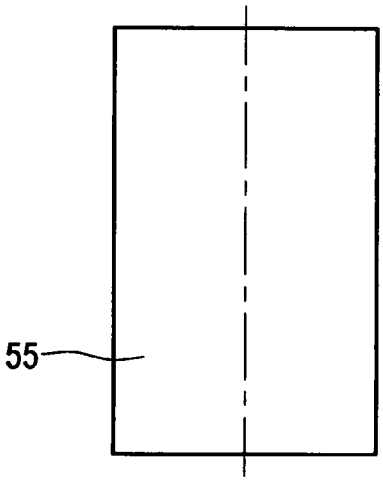

In order to achieve the different desired magnetic properties of the magnetic circuit component, base element 55 is submitted completely to a heat treatment, which is able to be performed, for instance, using hardening, deep cooling in deep-cooling refrigerators and/or by one-time or multiple reheating in ovens 56 (FIG. 3). After hardening, the microstructure may still also be made up of residual austenite proportions which are transformed into martensite by the subsequent heat treatment steps. Alternatively to this, the microstructure may also be made up of ferrite, having intercalated particles such as carbides, nitrides or intermetallic compounds. The heat treatment takes place in such a way that a completely magnetic martensitic material microstructure forms in base element 55 (FIG. 4).

Figure 5:
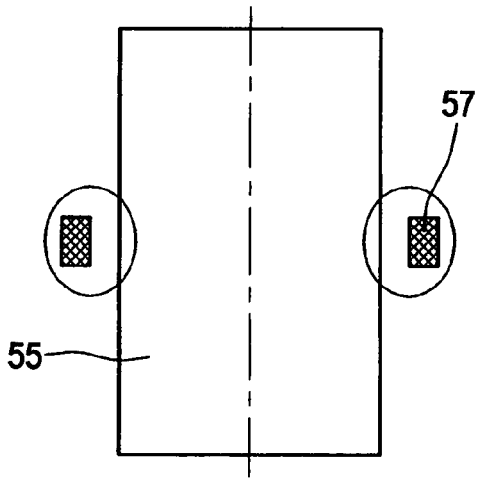
Figure 6:
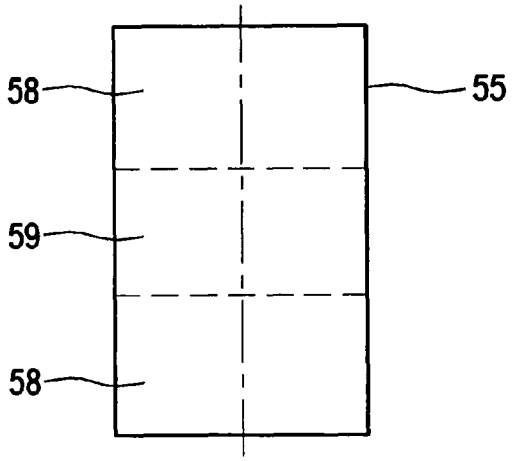

An additional heat treatment is subsequently undertaken which, however, is only carried out in a locally limited fashion. A subregion of base element 55 is exposed, for this purpose, to short-term heat treatment using laser heating or induction heating 57 (FIG. 5). In this way, the material of base element 55 is locally austenitized and homogenized in the subregion of the second heat treatment and, after cooling of base element 55 or self-quenching by the surrounding material, it is made up of martensitic regions 58 and subregion 59 having martensite and residual austenite (FIG. 6). Base element 55 is now made up of zones having various microstructures and magnetic properties.

Base element 55 is then finally treated in such a way that there exists a rigid housing 66 as magnetic circuit component in a desired geometry. In the case of the use of a housing 66 produced according to the present invention, in a fuel injector, it may be advantageous specifically to form housing 66 into shape by measures of production technology, such as ironing, tumbling, round-kneading, flanging and/or flaring. Housing 66 then represents a component that is able completely to take over the sum of the functions of the valve pipe, consisting of core 2, intermediate part 12 and valve seat support 16 in a known fuel injector according to FIG. 1, and consequently it extends, for example, over the entire axial length of a fuel injector.

Solid base element 55 is brought, for example, to form a pipe-shaped sleeve form, by production technology measures. Solid base element 55 may be provided, in this context, with an inner longitudinal opening 60 to form pipe-shaped housing 66 (FIG. 7), either before or only after the local heat treatment.

Figure 8:
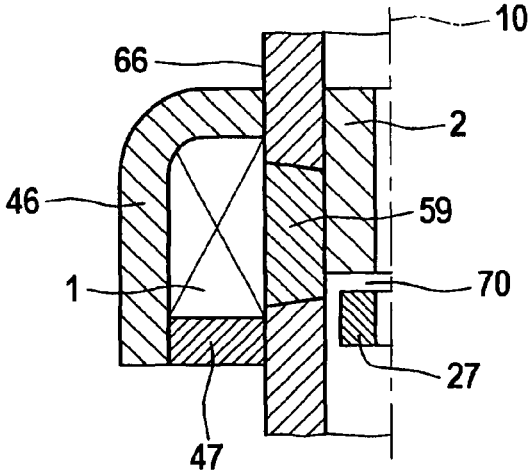
FIG. 8 shows a schematic cutout from an injector valve having a housing produced according to the present invention.
Figure 9:
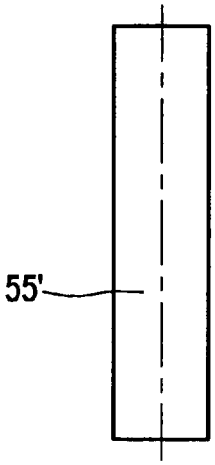
FIGS. 9 to 13 show schematic method steps of the method according to the present invention, for producing a rigid magnetic circuit component in the form of an armature bolt.

FIG. 8 shows a schematic cutout of a fuel injector having a housing 66 produced according to the present invention, which is installed in the valve as a thin-walled sleeve, and thus surrounds core 2 and armature 27 radially and in the circumferential direction, and is itself, in this context, surrounded by magnetic coil 1. It becomes clear that subregion 59 of housing 66, that has been changed in its magnetic properties and is martensitic and residually austenitic, lies in the axial extension region of a working air gap 70 between core 2 and armature 27, in order to conduct the magnetic circuit lines of force optimally and effectively in the magnetic circuit. Instead of bracket-shaped conducting element 45 shown in FIG. 1, the outer magnetic circuit component is executed, for instance, as a magnetic pot 46, the magnetic circuit being closed between magnetic pot 46 and housing 66 via a cover element 47. The method according to the present invention also makes it possible locally to change housing 66 in its magnetic properties, using greater wall thicknesses, so that a higher internal pressure stability is ensured in favor of the magnetic force, in spite of the minimized magnetically active region.

FIGS. 9 to 13 show schematic method steps of the method according to the present invention, for producing a rigid magnetic circuit component in the form of an armature bolt 66'.

Figure 7:
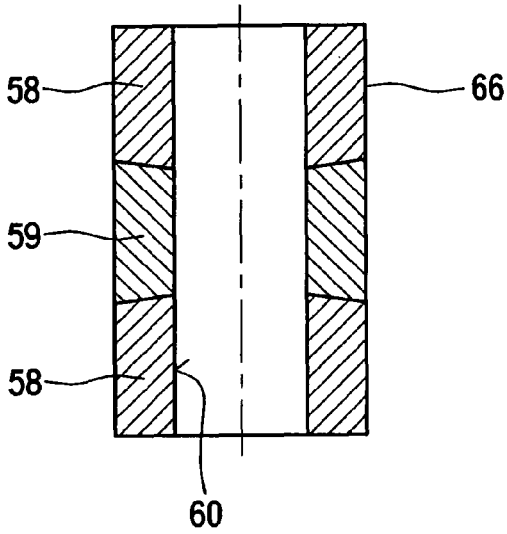

The production of armature bolt 66' takes place in a comparable manner to the previously described production of housing 66 according to FIG. 7. In a first method step (FIG. 9), a thin cylindrical base element 55' is provided, for instance, from which armature bolt 66' is to be produced, and which is made of a magnetic or a magnetizable material, and is ferromagnetic or ferritic, for example, or which has a martensitic material microstructure. Base element 55' may, for instance, be made of long rod material for an especially effective production of many armature bolts 66'. The material of base element 55' is a steel in each case, which forms residual austenite and martensite based on its alloy composition. The alloying elements in the material are the elements C, N, Ni and Mn, which stabilize austenite.

Figure 10:
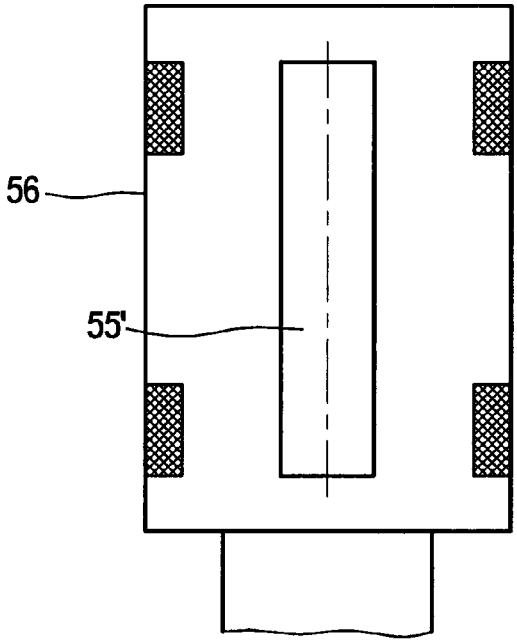
Figure 11:
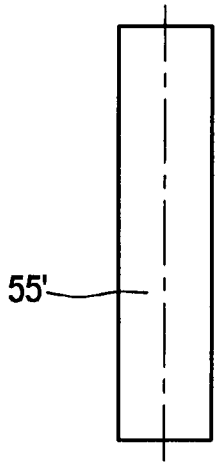

In order to achieve the different desired magnetic properties of the magnetic circuit component, base element 55' is submitted completely to a heat treatment, which is able to be performed, for instance, using hardening, deep cooling in deep-cooling refrigerators and/or by one-time or multiple reheating in ovens 56 (FIG. 10). After hardening, the microstructure may still also be made up of residual austenite proportions, which are transformed into martensite by the subsequent heat treatment steps. Alternatively to this, the microstructure may also be made up of ferrite, having intercalated particles such as carbides, nitrides or intermetallic compounds. The heat treatment takes place in such a way that a completely magnetic martensitic material microstructure forms in base element 55' (FIG. 11).

Figure 12:
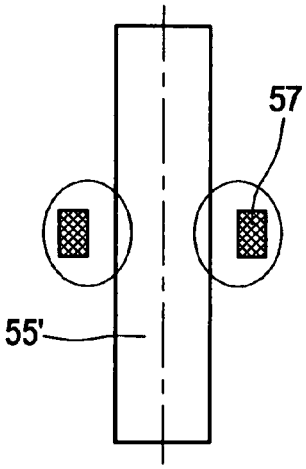
Figure 13:
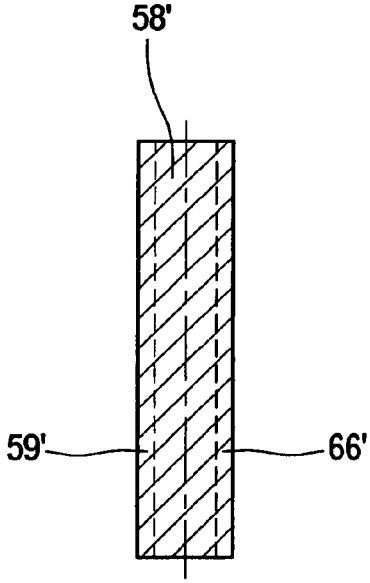

Thereafter, additional heat treatment is performed, which is supposed to lead to a change in the magnetic properties, exclusively at the surface in the edge regions of base element 55'. A surface of base element 55' is exposed, for this purpose, to short-term heat treatment using laser heating or induction heating 57 (FIG. 12). In this way, the material of base element 55' is locally austenitized and homogenized at the surface and, after the cooling of base element 55' or self-quenching by the surrounding material, it is made up of an inner martensitic regions 58' and an outer edge region 59' having martensite and residual austenite (FIG. 13). Base element 55' or armature bolt 66' is now made up of zones having various microstructures and magnetic properties.

Figure 14:
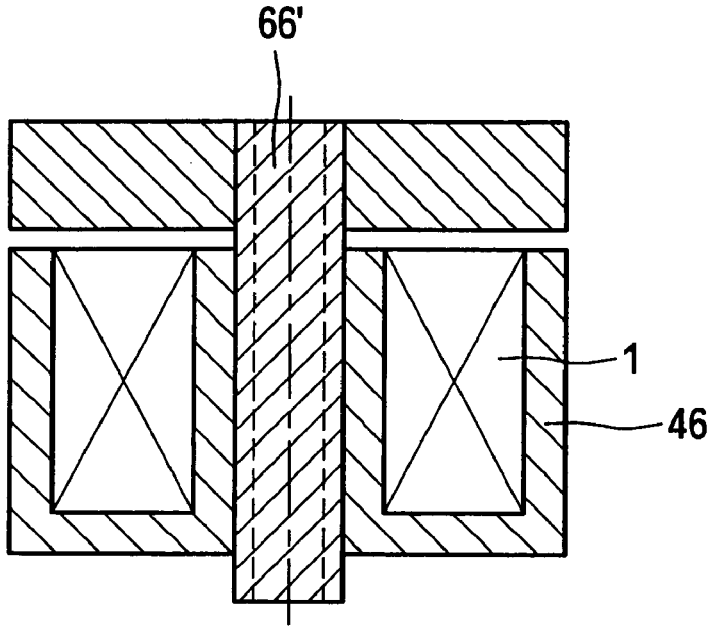
FIG. 14 shows a schematic cutout from a magnetic circuit in a plunger-type execution, having an armature bolt produced according to the present invention.

If necessary, base element 55' is then finally treated in such a way that there exists a rigid armature bolt 66' as magnetic circuit component, in a desired geometry. FIG. 14 shows a schematic cutout of a magnetic circuit in plunger-type execution, having an armature bolt 66' according to the present invention, which plunges through a magnetic pot 46 and is displaceable there in a movable manner. In the case of plunger-type magnetic circuits, the dynamics and the magnetic force of the magnetic valve are able to be improved, using an armature bolt 66', in which outer edge region 59' has residual austenite proportions. Coating methods, such as carbonitriding, may be omitted.

Figure 15:
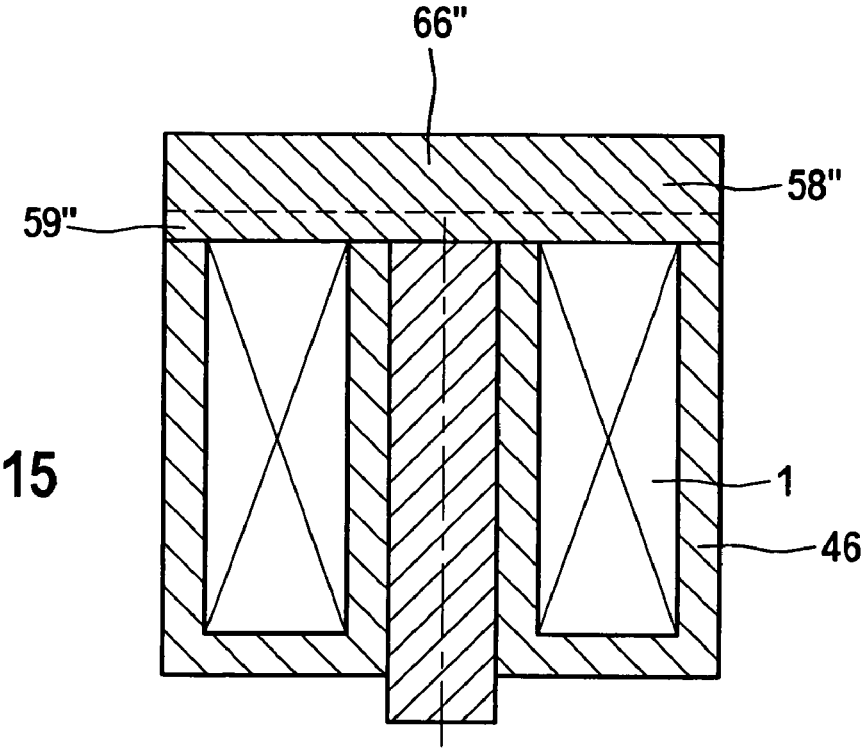
FIG. 15 shows a schematic cutout from a magnetic circuit in a flat-type armature execution, having a tie plate produced according to the present invention.

FIG. 15, a schematic cutout from a magnetic circuit in a flat-type armature execution is shown, having a tie plate 66", produced according to the present invention. The production principle is again comparable to the previously described method steps for producing housing 66 or armature bolt 66'. The local second heat treatment takes place in such a way that a short-term heat treatment is performed, using laser heating or induction heating, at one side of the flat, plate-shaped base element. In this way, the material of the base element is locally austenitized and homogenized on this side and, after the cooling of the base element or the self-quenching by the surrounding material, it is made up of a martensitic region 58" and an edge region 59" facing magnetic coil 1, having martensite and residual austenite. Tie plate 66" is now made up of zones having various microstructures and magnetic properties.

Using such a tie plate 66", an additional air gap is able to be generated in flat-type armature magnetic circuits. This additional air gap in edge region 59" may be used so as to prevent the adhesion of tie plate 66" to magnet pot 46, so as to set a specified residual air gap in the magnetic circuit or so as to have it used as an air gap having wear protection.

The present invention is by no means restricted to use in fuel injectors or magnetic valves for antilock systems, but relates to all electromagnetically operable valves in different fields g1 of application, and generally to all rigid housings in assemblies in which the zones of different magnetism are required successively.

What is claimed is:

1. A method for producing a rigid magnetic circuit component for an electromagnetically operable valve, the magnetic circuit component having at least two directly successive zones having different magnetic properties, the method comprising:

providing a base element made of one of a magnetic material or a magnetizable material;

providing a first heat treatment of the entire base element;

providing a second heat treatment of only a selected portion of the base element to form a subregion having a microstructure of martensite and residual austenite, wherein the remaining portion of the base element is martensitic; and installing the base element as the magnetic circuit component in a magnetic circuit.

2. The method as recited in claim 1, wherein the base element is ferromagnetic.

3. The method as recited in claim 2, wherein the base element is configured to be cylindrical.

4. The method as recited in claim 1, wherein the first heat treatment of the base element is achieved by one of hardening, deep cooling in a deep cooling refrigerator, or heating in an oven.

5. The method as recited in claim 4, wherein the second heat treatment of the selected portion of the base element takes place using one of laser heating or induction heating.

6. The method as recited in claim 5, further comprising:

after the second heat treatment, performing further processing of the base element to achieve a desired geometry of the magnetic circuit component.

7. The method as recited in claim 6, wherein the further processing of the base element includes at least one of ironing, tumbling, round-kneading, flanging and flaring.

8. The method as recited in claim 6, wherein the base element is installed in a magnetic circuit as one a sleeve-shaped housing, a rigid armature bolt or a flat tie plate.

* * * * *